United States Patent [19]

Sekiguchi

[11] 4,320,368

[45] Mar. 16, 1982

[54] FILTER FOR MICROWAVES

[75] Inventor: Mitsuo Sekiguchi, Soma, Japan

[73] Assignee: Alps Electric Co., Ltd., Tokyo, Japan

[21] Appl. No.: 137,494

[22] Filed: Apr. 4, 1980

[30] Foreign Application Priority Data

Apr. 9, 1979 [JP] Japan ..... 54-46762[U]

[51] Int. Cl.[3] ..... H01P 1/20; H01P 1/208; H01P 7/06

[52] U.S. Cl. ..... 333/209; 333/212; 333/232

[58] Field of Search ..... 333/202–212, 333/222–227, 231–235, 245, 248, 253; 334/40–45, 85

[56] References Cited

U.S. PATENT DOCUMENTS

| | | | |
|---|---|---|---|
| 3,273,083 | 9/1966 | Rose | 333/203 |
| 4,037,182 | 7/1977 | Burnett et al. | 333/209 |
| 4,216,488 | 8/1980 | Kasuga et al. | 333/203 |

*Primary Examiner*—Marvin L. Nussbaum

*Attorney, Agent, or Firm*—Guy W. Shoup; Gerard F. Dunne

[57] ABSTRACT

A microwave filter includes a plurality of resonator cavities which are separated by walls and which have respective resonator rods, and trimming caps made of a dielectric substance are fixed to the respective resonator rods.

10 Claims, 5 Drawing Figures

FILTER FOR MICROWAVES

BACKGROUND OF THE INVENTION

The present invention relates to a filter for microwaves, and more particularly to a microwave filter of the capacitive coupling type having a plurality of resonator cavities.

Conventional microwave filters have a construction wherein resonator rods are fixed to the respective resonator cavities by the use of screws or the like. This has led to the disadvantage that, when they are subjected to vibrations or impact, the resonance characteristics may vary. The applicant of the present application filed on July 27, 1979 a U.S. patent application Ser. No. 61,415, now U.S. Pat. No. 4,275,369, which described a microwave filter which has solved the aforecited disadvantage. The present invention concerns further improvements in such microwave filters.

SUMMARY OF THE INVENTION

An object of the present invention is to provide a microwave filter wherein the resonant frequency thereof can be trimmed readily.

Another object of the present invention is to provide a microwave filter which is immune against vibrations and shocks.

Still another object of the present invention is to provide a capacitive coupling type microwave filter which is structurally simple and is accordingly inexpensive.

Further objects and advantages of the present invention will become apparent from the following description taken with reference to the drawings.

PREFERRED EMBODIMENT OF THE INVENTION

Figure 1:
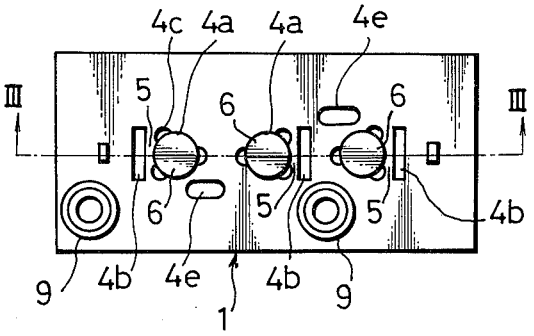
FIG. 1 is a top plan view of an embodiment of a microwave filter according to the present invention.
Figure 2:
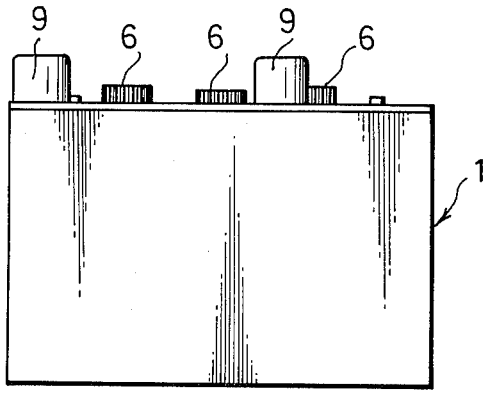
FIG. 2 is a side view of the embodiment.
Figure 3:
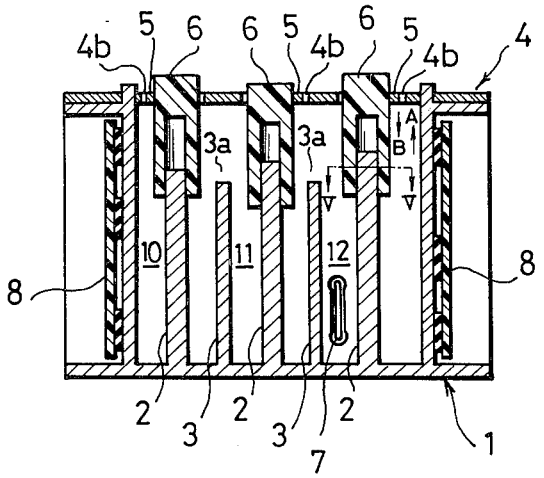
FIG. 3 is a sectional view taken along line III—III in FIG. 1.

Hereunder, an embodiment illustrated in FIGS. 1 to 5 will be described. A housing 1 made of metal is formed with a plurality of resonator cavities 10, 11 and 12 which are separated by a plurality of partition walls 3 and 3. The resonator cavities 10, 11 and 12 are provided with respective resonator rods 2 of $\lambda/4$ wavelength in a manner to extend from the bottom of the housing 1. Over the partition walls 3 and 3, there are formed coupling windows 3*a* and 3*a* for capacitively coupling the respectively adjacent resonator cavities. The upside of the housing 1 has an open end, to which a cover 4 made of metal is attached. The cover 4 is formed with inserting holes 4*a* each opposing a respective resonator rod 2 and these holes are each adapted to receive a respective trimming cap 6 made of a dielectric substance. A respective mounting slot 4*b* is provided in proximity to each inserting hole 4*a*, and deformable bridge pieces 5 are thus formed between each hole 4*a* and its associated slot 4*b*.

Figure 4:
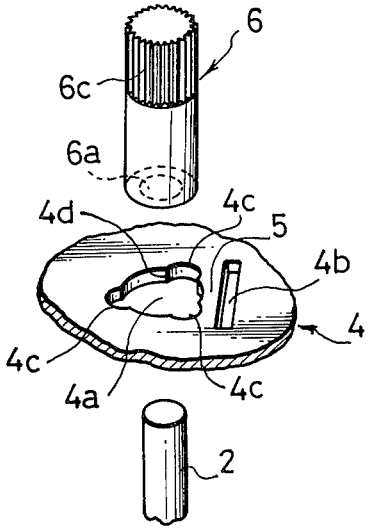
FIG. 4 is an exploded perspective view of parts of the microwave filter according to the present invention, for explaining the relationship among a trimming cap, a cover and a resonator rod.
Figure 5:
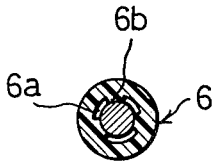
FIG. 5 is a sectional view taken along line V—V in FIG. 3.

As best seen from FIG. 4, notches 4*c* are formed in suitable portions of the border area of each inserting hole 4*a*. These notches 4*c* serve to receive a respective trimming cap 6 made of a dielectric substance such as polypropylene. The trimming caps each include a longitudinal recess 6*a* into which a respective resonator rod 2 may be snugly fitted; a plurality of projections 6*b* extending within the recess 6*a* and which are brought into resilient contact with the resonator rod 2; and serrations 6*c* which are formed in the outer periphery of the body of the cap. In mounting the trimming cap 6 onto the mounting plate or cover 4, the trimming cap 6 is inserted through the cap inserting hole 4*a* of the mounting plate 4 assembled on the housing 1, and the recess 6*a* of the trimming cap 6 is subsequently brought into tight engagement with the resonator rod 2 so as to embrace the resonator rod 2 by means of the projections 6*b*.

Therefore, the trimming cap 6 can be moved up and down (in the directions of arrows A and B of FIG. 3) with the resonator rod 2 as a guide. The upward or downward movement of the trimming cap 6 results in varying the dielectric constants between the resonator rod 2 and the surrounding members (housing 1, partition wall 3), whereby the trimmings of the resonant frequency and the characteristic impedance can be carried out.

After the frequency has been trimmed through the upward and downward movement of a trimming cap 6, a jig is inserted into the adjacent mounting hole 4*b* of the mounting plate 4, and the bridge piece 5 is deformed so as to push it against the side of the trimming cap 6. Then, the serrations 6*c* of the trimming cap 6 are pressed against the peripheral wall of the inserting hole 4*a*, and tips 4*d* (refer to FIG. 4) of the notches 4*c* provided in the inserting hole 4*a* bite into the serrations 6*c*. Thus, the installation of the trimming cap 6 on the mounting plate 4 is complete.

Numeral 7 designates a signal coupling loop which is disposed within the housing 1. A printed circuit board 8 is attached to the housing 1, and external lead terminals 9 are mounted on the latter. Shown at 4*e* are adjusting holes which are provided in the mounting plate 4 and which are used for adjusting the signal coupling loop 7.

As described above, according to the present invention, a trimming cap 6 can be passed through the inserting hole 4*a* of the cover or mounting plate 4, and the recess 6*a* of the trimming cap 6 is brought into engagement with the resonator rod 2. Therefore, the job of assembling the trimming cap 6 is easy, so productivity is high, and the trimming cap 6 can be moved up and down with the resonator rod 2 as the guide, so the trimming of the resonant frequency is facilitated. In addition, the trimming cap 6 is fixed in such a manner that one end part thereof embraces the resonator rod 2, while the other end part thereof is held against the inserting hole 4*a* of the mounting plate 4 by means of the bridge piece 5. Therefore, the trimming cap 6 is firmly supported, and a stable electric performance is ensured even against external vibrations and the like.

With the construction as in the foregoing embodiment wherein the serrations 6*c* are provided in the outer periphery of the trimming cap 6 and the notches 4*c* are provided in the appropriate portions of the inserting hole 4*a* of the mounting plate 4, the tips 4*d* of the notches 4*c* bite into the serrations 6*c* when the bridge piece 5 is deformed, so that the support of the trimming cap 6 can be secured still more. Further, with the construction wherein the resonator rod 2 is embraced by means of the projections 6*b* of the trimming cap 6, the external vibrations and the like can be absorbed by these projections 6*b*, so that an enhancement in the electric performance can be achieved.

Although, in the above embodiment, the trimming cap 6 has been explained as embracing the resonator rod 2 by means of the projections 6*b*, it is also possible to remove the projections 6*b* and embrace the resonator rod 2 directly by means of the inner wall of the recess 6*a* of the trimming cap 6. Needless to say, the shape of the trimming cap 6 is not restricted to the column as illustrated, but it can be put into various shapes including a cylinder, a hexagonal prism, an octagonal prism or the like and still be within the scope of the present invention set forth appended claims.

What is claimed is:

1. In a microwave filter having a conductive housing open on one end and having a plurality of resonator cavities separated from one another by walls; resonator rods disposed within the respective resonator cavities; coupling windows formed in the respective walls for coupling the respectively adjacent resonator cavities; and respective means associated with each said resonator rod for adjusting the capacitance effect of said resonator rods; the improvement wherein said adjusting means includes a respective trimming cap made from a dielectric material and fitting snugly over the end of each said resonator rod with sufficient frictional resistance therebetween to allow adjustment of the position of said trimming caps along the respective resonator rod.

2. A microwave filter according to claim 1, wherein said each trimming cap is formed with a recess for receiving the corresponding resonator rod.

3. A microwave filter according to claim 2, wherein said recess of said each trimming cap is formed with a plurality of projections extending towards the axis of said recess.

4. A microwave filter according to claim 1, wherein said trimming cap is made of polypropylene.

5. A microwave filter comprising a conductive housing having at least one resonator cavity each having a respective resonator rod of $\lambda/4$ wavelength extending upwardly from the bottom of the housing, and means including a dielectric trimming cap fitting snugly over an end portion of a respective resonator rod with sufficient frictional resistance to allow movement therebetween for varying the impedance of the microwave filter.

6. A microwave filter according to claims 1 or 5, further including a cover extending over the end of each said resonator rod and having means formed therein for holding each trimmer cap securely in place.

7. A microwave filter according to claim 6, and means including a respective hole snugly receiving each said trimmer cap and slots formed adjacent each said hole for receiving an insert member to spread the slot and deform it to urge the cover tightly against each trimmer cap.

8. A microwave filter according to claim 7, wherein said each hole includes a plurality of notches extending outwardly therefrom.

9. A microwave filter according to claim 7, wherein an inner wall of said hole is adapted to bite into an outer peripheral wall of said trimming cap when the corresponding slot is deformed.

10. A microwave filter according to claim 9, wherein said outer peripheral wall of said trimming cap is formed with serrations.

* * * * *